US007726347B2

(12) United States Patent
Mettler

(10) Patent No.: US 7,726,347 B2
(45) Date of Patent: Jun. 1, 2010

(54) DIVIDABLE TWO-PART HEALD SHAFT

(75) Inventor: Franz Mettler, Wollerau (CH)

(73) Assignee: Groz-Beckert KG, Albstadt (DE)

( * ) Notice: Subject to any disclaimer, the term of this patent is extended or adjusted under 35 U.S.C. 154(b) by 115 days.

(21) Appl. No.: 12/149,598

(22) Filed: May 5, 2008

(65) Prior Publication Data

US 2009/0277527 A1 Nov. 12, 2009

(30) Foreign Application Priority Data

May 14, 2007 (EP) ..... 07009593

(51) Int. Cl.
*D03C 9/00* (2006.01)
*D03C 9/06* (2006.01)
*D03C 13/00* (2006.01)

(52) U.S. Cl. ..... 139/55.1; 139/35; 139/57; 139/82; 139/91

(58) Field of Classification Search ..... 139/35, 139/48, 55.1, 56, 57, 58, 64, 79, 80, 81, 82, 139/83, 84, 88, 89, 91, 92
See application file for complete search history.

(56) References Cited

U.S. PATENT DOCUMENTS 1,725,004 A * 8/1929 Kaufmann ..... 139/92
2,668,559 A * 2/1954 Leveque ..... 139/92
2,687,148 A * 8/1954 Pfarrwaller ..... 139/58
2,708,455 A * 5/1955 Kaufmann ..... 139/92
2,796,083 A * 6/1957 Kaufmann ..... 139/92
2,981,293 A * 4/1961 Nussbaum ..... 139/91
3,180,367 A * 4/1965 Kaufmann ..... 139/91
3,220,441 A * 11/1965 Kaufmann ..... 139/92
3,335,759 A * 8/1967 Koch ..... 139/91
3,362,437 A * 1/1968 Kaufmann ..... 139/92
3,949,788 A * 4/1976 Speich ..... 139/57
4,041,986 A * 8/1977 Resch et al. ..... 139/58
4,083,385 A * 4/1978 Pfarrwaller ..... 139/57
4,349,052 A * 9/1982 Yaji et al. ..... 139/92
4,355,667 A * 10/1982 Shimizu ..... 139/91
4,460,020 A * 7/1984 Juillard ..... 139/82
4,508,145 A * 4/1985 Bowen et al. ..... 139/92
5,082,029 A * 1/1992 Dornier ..... 139/1 E
5,232,025 A * 8/1993 Gysin et al. ..... 139/92
5,370,157 A * 12/1994 Oertli ..... 139/82
5,483,995 A * 1/1996 Oertli ..... 139/57
5,483,996 A * 1/1996 Mettler ..... 139/91
5,787,935 A * 8/1998 Mettler et al. ..... 139/92
5,810,055 A * 9/1998 Haeussler et al. ..... 139/57
5,887,629 A * 3/1999 Mettler et al. ..... 139/91

(Continued)

*Primary Examiner*—Bobby H Muromoto, Jr.
(74) *Attorney, Agent, or Firm*—Fitch, Even, Tabin & Flannery; Norman N. Kunitz

(57) ABSTRACT

The heald shaft (1) for weaving machines is divided into a machine-resident frame part (14) and a removable frame part (15). While the removable frame part (15) supports a heald mounting rail (30) that must be released from said frame part for a heald change, said removable frame part is associated with an additional heald mounting rail (33) that is releasably held on the lower shaft rod (16). The upper shaft rod (25), together with the two heald mounting rails (30, 33), forms a removable frame part (15). The lower shaft rod (16), together with the lateral supports (19, 20), forms a machine-resident frame part. Preferably, the lateral supports (19, 20) and the lower shaft rod (16) are rigidly connected to each other.

5 Claims, 4 Drawing Sheets

U.S. PATENT DOCUMENTS

| | | | | |
|---|---|---|---|---|
| 6,732,767 | B2 * | 5/2004 | Baumann | 139/92 |
| 2005/0056334 | A1 * | 3/2005 | Bruske et al. | 139/91 |
| 2005/0061385 | A1 * | 3/2005 | Gesing | 139/91 |
| 2005/0081943 | A1 * | 4/2005 | Olbing et al. | 139/92 |
| 2006/0048836 | A1 * | 3/2006 | Bruske et al. | 139/82 |
| 2006/0070680 | A1 * | 4/2006 | Mettler | 139/93 |
| 2007/0006930 | A1 * | 1/2007 | Drope et al. | 139/11 |
| 2007/0181206 | A1 * | 8/2007 | Deseyne et al. | 139/91 |

* cited by examiner

DIVIDABLE TWO-PART HEALD SHAFT

CROSS REFERENCE TO RELATED APPLICATION

This application claims the priority of European Patent Application No. 07 009 593.0, filed on May 14, 2007, the subject matter of which, in its entirety, is incorporated herein by reference.

BACKGROUND OF THE INVENTION

The invention relates to a heald (heddle) shaft for weaving machines.

Weaving machines comprise heald shafts, said shafts bearing healds. The healds are disposed to guide warp threads and to form sheds. As a rule, the healds are accommodated on two spaced apart, parallel heald mounting rails, which, in turn are held on shaft rods. The shaft rods are part of a rectangular frame that is referred to as the heald shaft. In order to form sheds, said heald shaft is moved rapidly up and down. The shaft rods that are horizontally arranged during use support the individual heald mounting rails and, as a rule, their ends are connected via lateral supports. The lateral supports may be removed for the installation and deinstallation of the healds. However, as a rule, this is done after the heald shaft has been taken out of the weaving machine. To do so, said heald shaft must be separated from a corresponding drive device and pulled out of its guides. However, this requires an appropriately releasable coupling between the heald shaft and the drive device. In addition, the guides must be set up so as to release the heald shaft as needed, so that said heald shaft may be pulled out.

Furthermore, for example from document DE 196 07 532 A1, a concept has been known, which allows the heald shaft to remain in the weaving machine when the healds are replaced. Only the heald mounting rails with the healds are removed. The heald mounting rails are releasably connected to the shaft rods. However, these connections are critical at higher operating speeds of the weaving machine. In addition, the transport of two heald mounting rails with healds mounted thereto represents somewhat of a problem due to the considerable flexibility of the heald mounting rails alone. In addition, the overall system consisting of two heald mounting rails with healds seated on them is unwieldy.

Considering this, it is the object of the invention to provide an improved heald shaft and an improved weaving machine.

SUMMARY OF THE INVENTION

The above object is generally achieved according to the invention by a heald shaft which In a mounted state, represents a frame of an at least approximately rectangular construction. The frame is divided into a machine-resident frame part and at least one removable frame part that is releasably attached to the machine-resident frame part. The minimum of two frame parts complement each other to form a complete rectangular frame. The machine-resident frame part is preferably set up in such a manner that, after it has been mounted to the weaving machine, it remains permanently on said weaving machine. In contrast, the removable frame part can be detached from the machine-resident frame part and removed from the weaving machine.

This concept permits the connection of the drive device with the machine-resident frame part and permits the omission of interposed releasable coupling means. As a result of this, it is possible to optimize the drive and connecting means with regard to their transmission of force and with regard to their weight.

Furthermore, this concept in accordance with the invention allows that the machine-resident frame part may be supported or guided in a guide that is optimized in view of the technical problem that is to be solved, without having to take into account whether or not the guide elements of the guide need to be separated from each other. In the present case, it is thus preferred that the machine-resident frame part comprise all of those frame parts that are connected to the drive device or to the guide device, or are in direct relation to said devices.

Preferably, the machine-resident frame part is associated with at least one guide means or guide device that permits a shed-forming motion.

The at least one removable frame part is preferably that frame part which is in direct relation neither with the drive device nor with the guide device.

For example, the machine-resident frame part comprises a shaft rod and two lateral supports. Preferably, both lateral supports are rigidly connected to the shaft rod. The lateral supports and the shaft rod of the machine-resident frame part preferably subtend a right angle. The two lateral supports may be aligned parallel to each other. The lateral supports—like the shaft rod connecting them—may be constructed in a stiff lightweight design. Different from conventional constructions, where the lateral supports were preferably connected in an articulating manner to the shaft rod, now the lateral support, its connection to the shaft rod and the shaft rod itself, may be optimized regarding their rigidity. Cost aspects may be of secondary importance here because—different from conventional heald shafts—the machine-resident frame part need be provided only one time, and it is not necessary to store several of them.

In addition, with the use of the inventive arrangement, it is possible to laterally guide and support the heald shafts in a precise manner. The bearing may be configured so as to display very minimal play. The bearing may be provided with continuous re-lubrication. As a result of this, the heald shaft is driven in an essentially quieter manner and with less vibration. This offers the possibility of a distinct increase of the weaving speed, without having to potentially take into account any premature wear and damage.

The acceleration of the working speed of the weaving machine is also made possible in that the inherently stiff lateral supports of the machine-resident frame part are rigidly connected to the shaft rod of the machine-resident frame part, whereby the corner connection is also very stiff. Even if the connection of the removable frame part occurs via less rigid connecting means, the overall rectangular heald shaft is stiff at two of its corners, which strongly counteracts any bending in vertical direction.

The removable frame part preferably consists of a shaft rod which complements the machine-resident, preferably U-shaped, frame part to form a closed rectangular frame. Preferably, two heald mounting rails are connected to the removable frame part to the extent that a simple joint transport to and from the weaving machine is possible. In so doing, at least one of the heald mounting rails is preferably connected to the shaft rod in a fixed manner. The other heald mounting rail may also be connected to the first heald mounting rail and the shaft rod, for example, via healds. As a supplementary or alternative measure, the second heald mounting rail may be connected by means of at least one appropriate holder, for example, joint bars, tension bands or the like. In so doing, a joint transport of the removable frame part, the heald mounting rails and the healds, to and from the weaving machine becomes possible in a simple manner. The healds that are required for weaving are brought to the weaving machine with this removable frame part. In so doing, the warp threads have preferably already been drawn in.

Whereas the first heald mounting rail is preferably permanently connected to the removable frame part, the second heald mounting rail is preferably releasably connected to the machine-resident frame part. For example, the second heald mounting rail is screwed to the machine-resident frame part, in particular to its shaft rod. Other connecting or coupling means are also possible, for example, hooks, joint bars or the like.

Additional details of advantageous embodiments of the invention are obvious from the drawings, the description or the claims. The description is restricted to essential aspects of the invention and miscellaneous situations. Persons skilled in the art may learn additional details from the drawings.

The drawings show exemplary embodiments of the invention.

DETAILED DESCRIPTION OF THE INVENTION

Figure 1:
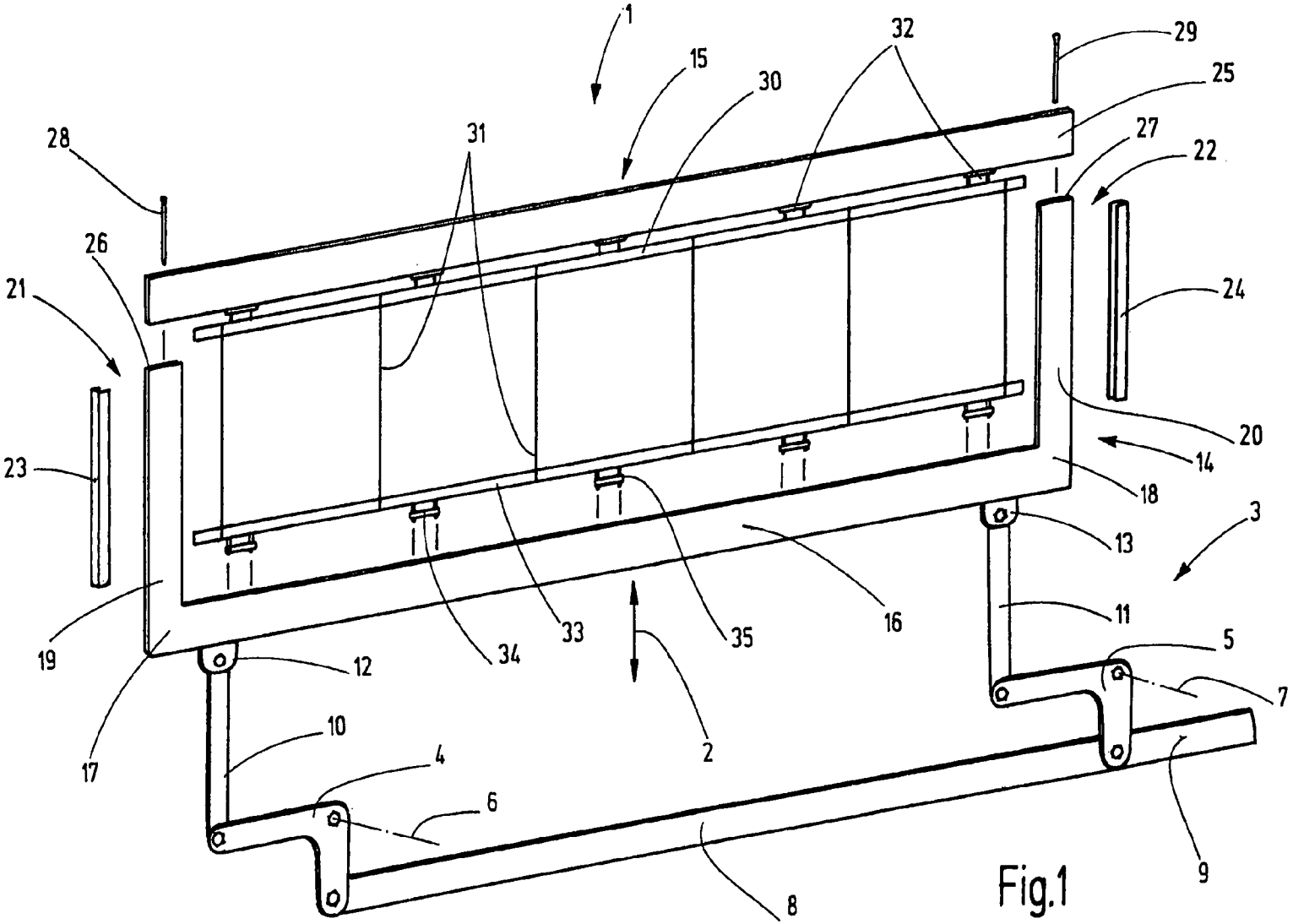
FIG. 1 is a partially exploded view of a first embodiment of a heald shaft in accordance with the invention.

FIG. 1 shows a heald shaft 1 which is used for shed-forming in a weaving machine. To do so, the heald shaft 1 is driven to perform a vertical up-and-down movement as is symbolically indicated by an arrow 2 in FIG. 1. A drive device 3 is provided, said device imparting the heald shaft 1 with this motion. The drive device 3, for example, comprises a rod assembly that may include two or more rectangular levers 4, 5 that are supported so as to be pivotable about stationary rotational axes 6, 7. While the ends of these rectangular levers 4, 5—preferably facing downward when in use—can be connected to each other via a connecting rod 8 and to a shed-forming machine via a joint bar 9, the preferably approximately horizontally aligned arms of the rectangular levers 4, 5 are connected to the heald shaft 1 via joint bars 10, 11. The respective lower end of said joint bars is preferably connected to the rectangular levers 4, 5 in an articulating manner, and their upper end is connected to the heald shaft 1 via joints 12, 13. The joints 12, 13 may be configured as low-play permanently lubricated joints, for example with sliding bearings or rolling bearings. In addition, they may be included in a lubrication circuit. A releasable coupling means between the rectangular lever 4, 5 and the heald shaft 1 is neither necessary nor provided.

As shown by the exploded view of FIG. 1, the heald shaft 1 is divided into a machine-resident frame part 14 and a removable frame part 15. During heald replacement, the machine-resident frame part 14 is intended to remain in the weaving machine. This does not exclude, in principle, that said frame part 14 can be removed from the weaving machine; in which case the scope of assembly measures required therefore is of subordinate importance. During the standard heald or warp thread change, however, said frame 14 is intended to remain in the weaving machine.

Referring to the preferred embodiment, the machine-resident frame part 14 comprises, when in use, preferably a horizontally extending essentially straight section which may be viewed as the lower shaft rod 16. For example, it consists of a hollow profile, for example, an extrusion-molded hollow profile of aluminum, a fiber-reinforced hollow profile of plastic material or another bearing structure which is inflexible, in particular in view of the forces in the direction of the arrow 2. The lower shaft rod 16 may be a light-weight profile with low weight and high flexural rigidity. At its two ends 17, 18, the shaft rod 16 is connected to the lateral supports 19, 20, that preferably subtend an angle of 90° with the shaft rod 16. The lateral supports 19, 20 are aligned parallel to each other as a result of this and, together with the shaft rod 16, form a shallow "U". The lateral supports 19, 20 may essentially have the same cross-section as the lower shaft rod 16. They may also consist of a lightweight profile and may be particularly flexible. In addition, their ends 17, 18 are preferably rigidly connected to the shaft rod 16. The connection may be established by subsequent connection of the lateral supports 19, 20 to the shaft rod 16 by welding, cementing, screwing, riveting or other connecting means. In such a case, the lateral supports 19, 20 and the shaft rod 16 are independent separate parts. The connection of the lateral supports 19, 20 to the shaft rod 16 may be alternatively established, in that the lateral supports 19, 20 and the shaft rod 16 are manufactured as a joint one-piece component, for example, of fiber-reinforced plastic material, with or without hollow chambers, reinforcement linings or the like. To the extent that hollow chambers exist in the components that are used, they may be filled with sound-damping agents, for example foam, for the purpose of noise reduction.

The lateral supports 19, 20 are associated with linear guides 21, 22 to which belong guide elements 23, 24 that are only symbolically indicated in FIG. 1. They may be slip-in guides, rolling element guides or the like, whereby these interact directly with the lateral supports 19, 20 or, for example, with metal slide ways provided on the lateral supports 19, 20. The guide elements 23, 24 may be in connection with a lubricating device which continuously supplies lubricant to the appropriate support surfaces. In addition, the corresponding bearings may be designed with extremely minimal play as a result of the stiffness of the machine-resident frame part 14. It is also possible to support one of the guide elements 23, 24 in a stationary manner and the other guide element in a movable, floating or damping manner relative to the longitudinal direction of the lower shaft rod 16. In this case, the linear guides may be configured with almost no play and ensure a very quiet movement of the heald shaft 1.

The removable frame part 15 is represented, for example, by an upper shaft rod 25 which, in turn—like the lower shaft rod 16—may be constructed as a light-weight profile. It may have the same cross-section as the lower shaft rod 16 or may have a different cross-section. It may be constructed in the same manner as the lower shaft rod 16 or it may be constructed in a different way. The removable frame part 15 is connected to the machine-resident frame part 14, preferably in a manner so that it can be detached. To achieve this, the shaft rod 25 may be screwed to the lateral supports 19, 20. For example, in so doing, corresponding sections of the lower side of the shaft rod 25 and the end sections 26, 27 of the lateral supports 19, 20 form a corresponding interface. Fastening bolts 28, 29 may be used for the purpose of connection, said bolts passing through the upper shaft 25 preferably in vertical direction and fitting into threaded bores that are provided in the lateral supports 19, 20. The connection between the removable frame part 15 and the machine-resident frame part 14 may also be provided by other releasable connection mean, for example, joint bars with detents.

The upper shaft rod 25 holds a first (upper) heald mounting rail 30, on which are seated several healds 31 that are only sporadically indicated in FIG. 1. In so doing, the healds 31 are held by their end eyelets alongside the heald mounting rail 30. The heald mounting rail 30 is connected to the shaft rod 25 via suitable connecting means, for example, joint bars 32. The connection may be permanent, i.e., it cannot be released.

While the upper end eyelets of the healds 31 are seated on the heald mounting rail 30, their lower end eyelets are held on a lower heald mounting rail 33. During operation, this is connected to the machine-resident frame part, however, it can be released, if needed. For the purpose of connection, connecting bars 34 may be provided. To achieve connection, connecting bars 34 may be provided, each of said bars being associated with one or more connecting screws 35. Via said screws, the connecting bars 34 are releasably connected to the lower shaft rod 16. Consequently, the lower heald mounting rail 33 is releasably connected to the lower shaft rod 16. For the purpose as defined by the invention, it is also possible to use other connecting means, e.g., screwless connections, i.e., plug connections.

Heald replacement is done as follows:

During operation, the mounting screws 28, 29, 35 are tightened. The removable frame part 15 and the machine-resident frame part 14 are connected so as to form a stiff rectangular frame. The drive device 3 is used to move the heald shaft 1 up and down.

If the healds 31 are to be exchanged, the heald shaft 1 is moved into replacement position. This is, for example, an upper reversing position. In this position, the fastening screws 28, 29, 35 are released. Now, the removable frame part 15 can be taken out of the weaving machine. If said frame part is lifted upward, the healds 31 held on said frame's heald mounting rail 30 take along the lower heald mounting rail 33. The entire unit can be taken out of the machine and, for example, be transferred to a thread drawing-in machine.

Now, if these or other healds are reintroduced into the weaving machine, the respective removable frame part 15, together with its healds 31 and the lower heald mounting rail 33, is again returned to the weaving machine and slid from the top into the lower machine-resident frame part 14. Upon inserting and tightening all the fastening screws 28, 29, 35, the weaving machine is again ready for operation.

Whereas the machine-resident frame part 14 exists only once per heald shaft and remains in the machine, a larger supply of removable machine parts 15, besides heald mounting rails and healds, may be kept ready. Therefore, it is justified to optimize the machine-resident frame part 14 optionally by taking into account increased manufacturing time or manufacturing costs, in view of said frame's durability and rigidity. It is also justified to optimize the removable frame part 15 with less consideration for its stiffness in view of required manufacturing time or manufacturing costs.

Figure 2:
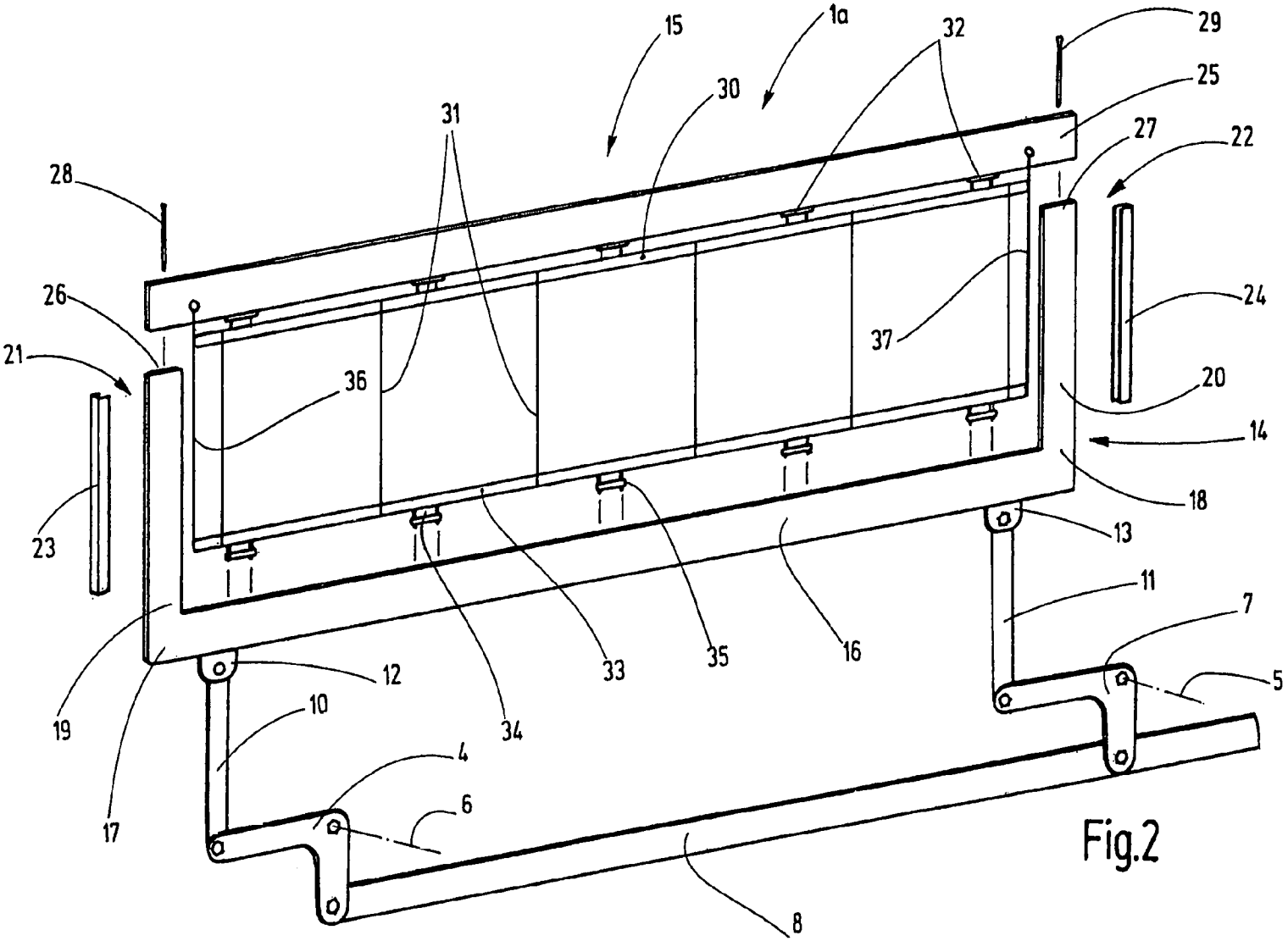
FIG. 2 is a partially exploded view of a modified embodiment of the heald shaft in accordance with the invention.

To this extent, numerous modifications of the shown invention are possible, only a few of these being explained hereinafter:

FIG. 2 shows a heald shaft 1*a* which is largely identical to the heald shaft 1 in accordance with FIG. 1. Therefore, using the same reference numbers, the previous description applies analogously.

Whereas the heald mounting rail 33 in the above-described exemplary embodiment is held on the removable frame part 15 only by the healds 31, additional holders 36, 37 are provided in the exemplary embodiment in accordance with FIG. 2. These holders are attached to the ends of the heald mounting rail 33 or also to one or several connecting bars 34. The holders 36, 37 may be flexible metal bands, steel wires, steel ropes or the like. The may be connected to the heald mounting rail 33 and/or to the shaft rod 25 in a permanent or releasable manner, with or without play. In the individual case even a single holder, for example, centrally contacting the heald mounting rail 33, may be sufficient.

Figure 3:
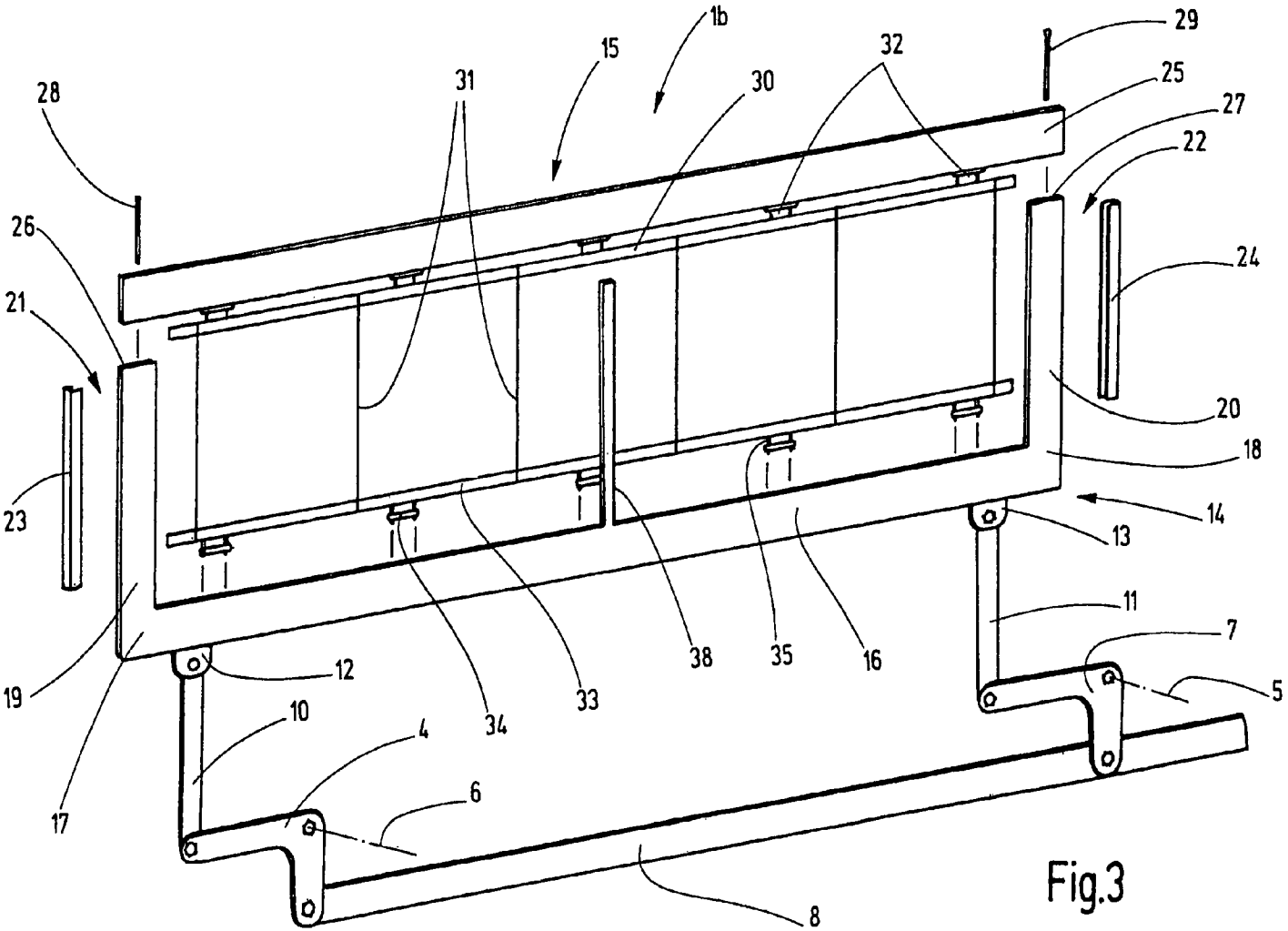
FIG. 3 is a partially exploded view of the heald shaft in accordance with the invention with a central support.

FIG. 3 shows another modified embodiment of the invention. Again, using the existing reference numbers, reference is made to the above description.

The heald shaft 1*b* in accordance with FIG. 3 has at least one intermediate or central support 38 that is arranged parallel to the lateral supports 19, 20. Said support is preferably releasably connected to the removable frame part 15 and preferably permanently connected to the machine-resident frame part 14. There may be holders 36, 37, or they may be omitted.

Figure 4:
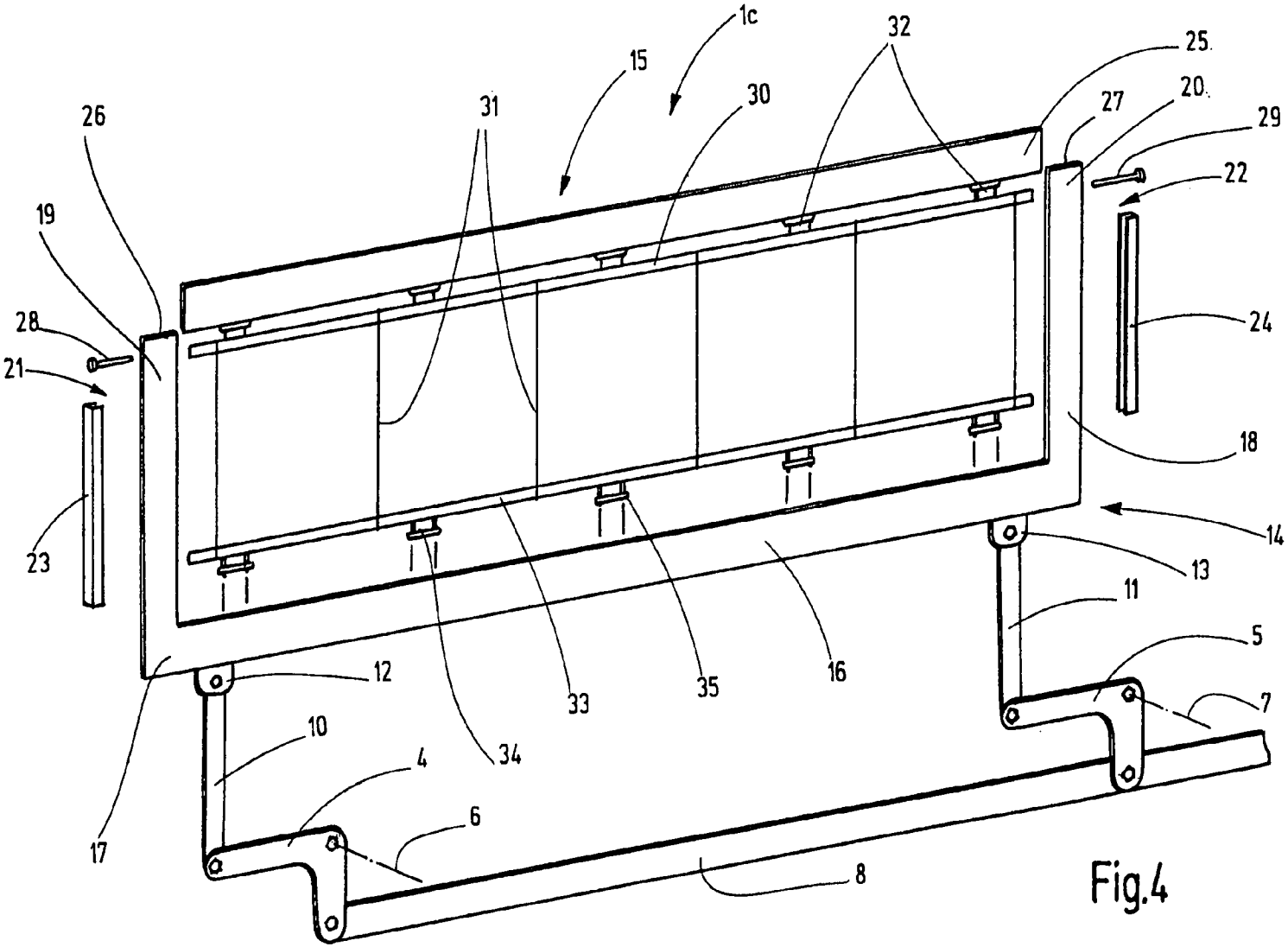
FIG. 4 is a partially exploded view of another embodiment of the heald shaft in accordance with the invention.

FIG. 4 shows another modification. The description for the heald shafts 1, 1*a* in accordance with FIG. 1, 2 or 3 apply analogously. The heald shaft 1*c* in accordance with FIG. 4 has been modified in so far as the upper shaft rod 25 is not seated on the end surfaces 26, 27 of the lateral supports 19, 20 but is interposed between the lateral supports 19, 20. The connection between the upper shaft rod 25 and the lateral supports 19, 20 may be rigid or articulated. However, in any event, the lower shaft rod 16 is again rigidly connected to the lateral supports 19, 20. The stiffness of the connection between the lateral supports 19, 20 and the lower shaft rod 16 ensures the overall stiffness of the entire heald shaft 1*c*.

The inventive heald shaft 1 for weaving machines is divided into a machine-resident frame part 14 and a removable frame part 15. While the removable frame part 15 supports a heald mounting rail 30 that must be released from said frame part for a heald change, said removable frame part is associated with an additional heald mounting rail 33 that is releasably held on the lower shaft rod 16. The upper shaft rod 25, together with the two heald mounting rails 30, 33, forms a removable frame part 15. The lower shaft rod 16, together with the lateral supports 19, 20, forms a machine-resident frame part. Preferably, the lateral supports 19, 20 and the lower shaft rod 16 are rigidly connected to each other.

It will be appreciated that the above description of the present invention is susceptible to various modifications, changes and modifications, and the same are intended to be comprehended within the meaning and range of equivalents of the appended claims.

LIST OF REFERENCE NUMBERS

1 Heald shaft
2 Arrow
3 Drive device
4, 5 Rectangular lever
6, 7 Rotational axes
8 Connecting rod
9 Joint bar
10, 11 Connecting bars
12, 13 Joints
14 Machine-resident frame part
15 Removable frame part
16 Lower shaft rod
17, 18 Ends
19, 20 Lateral supports
21, 22 Linear guides
23, 24 Guide elements
25 Upper shaft rod
26, 27 End surfaces

28, 29 Fastening bolts
30 Heald mounting rail
31 Healds
32 Joint bars
33 Heald mounting rail
34 Connecting bars
35 Fastening screw
36, 37 Holder
38 Central support

What is claimed is:

1. Heald shaft for weaving machines, comprising:

a machine-resident frame part that is to be mounted to the weaving machine, and a removable frame part that is detachably connected to the machine-resident frame part and complements the machine-resident frame part (14) to form a complete rectangular frame; and wherein the machine-resident frame part comprises a first shaft rod and two lateral supports that are connected to each other to form a U-shaped frame part, the removable frame part comprises only a second shaft rod that is releasably connected to the lateral supports, a first heald mounting rail is supported on the removable frame part, a second heald mounting rail is connected to the machine resident frame part via a releasable coupling means, and means, in addition to the lateral supports, for connecting the second heald mounting rail and the removable frame part, whereby the removable frame part and the first and second heald mounting rails can be separated as a unit from the machine resident frame part, which can remain mounted on a weaving machine, when the releasable connection between the second shaft rod and the lateral supports and the releasable connection of the coupling means are both released.

2. Heald shaft in accordance with claim 1, wherein the shaft rod and the lateral supports are rigidly connected to each other.

3. Heald shaft in accordance with claim 1, wherein the means connecting the removable frame part and the second heald mounting rail are healds.

4. Weaving machine comprising at least one heald shaft in accordance with claim 1.

5. Heald shaft in accordance with claim 1, wherein the means connecting the removable frame part and the second heald mounting rail are at least one holding strap.

* * * * *